US005915569A

United States Patent [19]

Kerrien et al.

[11] Patent Number: 5,915,569

[45] Date of Patent: Jun. 29, 1999

[54] DEVICE FOR SEPARATION AND PROPORTIONING OF DIFFERENT SIZED OBJECTS SUCH AS HULLS AND END PIECES ORIGINATING FROM CUTTING IRRADIATED NUCLEAR FUEL ASSEMBLIES

[75] Inventors: Philippe Kerrien, Montigny le Bx; Roger Lahille, Plaisir; Serge Le Cocq, Montigny.le.Bretonneux, all of France

[73] Assignee: Compagnie Generale des Matieres Nucleaires, Velizy Villacoublay, France

[21] Appl. No.: 08/803,944

[22] Filed: Feb. 21, 1997

[30] Foreign Application Priority Data

Feb. 26, 1996 [FR] France ..... 96 02341

[51] Int. Cl.[6] ..... B03B 7/00; B03B 5/60; B07B 1/22

[52] U.S. Cl. ..... 209/659; 209/17; 209/173; 209/208; 209/270; 209/288; 209/291

[58] Field of Search ..... 209/17, 173, 208, 209/270, 284, 288, 291, 2, 659

[56] References Cited

U.S. PATENT DOCUMENTS

| | | | |
|---|---|---|---|
| 13,449 | 8/1855 | Seymour | 209/291 |
| 361,413 | 4/1887 | Hendershot | 209/291 X |
| 545,689 | 9/1895 | Heinz | 209/291 |
| 1,387,238 | 8/1921 | Cave | 209/291 X |
| 3,756,406 | 9/1973 | Khan et al. . | |
| 4,159,242 | 6/1979 | Walker | 209/17 X |
| 4,512,881 | 4/1985 | Shumway et al. | 209/270 |
| 5,082,553 | 1/1992 | Tanii | 209/288 X |
| 5,524,769 | 6/1996 | Spencer | 209/270 |
| 5,587,073 | 12/1996 | Zittel | 209/291 |

FOREIGN PATENT DOCUMENTS

| | | |
|---|---|---|
| 443683 | 9/1912 | France . |
| 2550106 | 2/1985 | France . |

OTHER PUBLICATIONS

Patent Abstracts of Japan, vol. 18, No. 520 (C–1255), Sep. 30, 1994 & JP–A–06 178949 (Isao Iijima), Jun. 28, 1994.

*Primary Examiner*—David A. Bucci
*Assistant Examiner*—Steven B. McAllister
*Attorney, Agent, or Firm*—Pearne, Gordon, McCoy & Granger LLP

[57] ABSTRACT

A device comprising two coaxial drums (22, 24) is proposed in order to separate and then proportion objects of different sizes. The objects are introduced into one end of the inner drum consisted mainly of a coil (32) wound in a spiral. Large objects are retained in this inner drum and are routed when in rotation. Small objects drop into the outer drum (24) and are routed to its other end when it is driven in rotation. Small objects drop into the outer drum (24) and are routed to its other end through a spiral inner header (50) when it is driven in rotation. Thus objects such as hulls and end pieces obtained after cutting irradiated nuclear fuel assemblies can be separated and then proportioned.

13 Claims, 4 Drawing Sheets

DEVICE FOR SEPARATION AND PROPORTIONING OF DIFFERENT SIZED OBJECTS SUCH AS HULLS AND END PIECES ORIGINATING FROM CUTTING IRRADIATED NUCLEAR FUEL ASSEMBLIES

TECHNICAL FIELD

The invention relates to a device for separating different sizes of objects, and then proportioning them.

Although this type of device may be used in many industries, it is particularly suitable for use in a plant for the reprocessing of irradiated fuel taken from nuclear reactors. In this type of plant, in particular the device according to the invention may be used to separate hulls and/or end pieces created by cutting nuclear fuel assemblies.

For a good understanding of the term "hulls" and "end pieces", remember that a nuclear fuel assembly comprises a rigid frame used to support a bundle of rods containing the nuclear fuel. Each rod is formed principally of a "Zircaloy" (registered trademark) tubular cladding containing nuclear fuel in the form of a stack of pellets. The frame comprises mainly two solid end pieces supporting the rod bundle, and guide tubes connecting these end pieces together.

The segments of cladding obtained after cutting nuclear fuel assemblies and after passing the segments in a dissolver, are called "hulls".

The solid end pieces of the frame of a nuclear fuel assembly after this assembly has been cut, are called "end pieces".

STATE OF THE ART

The main function of irradiated nuclear fuel reprocessing plants is to recover uranium and plutonium still present in the irradiated assemblies, for reuse to make new assemblies.

Another purpose of reprocessing plants is selective packaging of waste formed by the non-reusable parts of the irradiated assemblies, depending on their nature.

In a reprocessing plant, the irradiated assemblies are firstly cut over their entire length. The segments obtained are then transferred into a dissolver so that the irradiated nuclear fuel present in the cladding segments is separated from the purely mechanical elements making up the hulls and end pieces. Fission products are then separated from the irradiated nuclear fuel. Finally, the uranium and plutonium are separated.

At the present time, high activity waste obtained at the outlet from the dissolver which consists mainly of end pieces and hulls received in bulk in specific drums. They are then coated without change in a cement grout, and the drums are closed by welding on a safety cover. Finally, the drums sealed in this manner are stored on a suitable site.

It is desirable to compact this waste in order to significantly reduce its volume. This is done by inserting the hulls and end pieces in casings suitable for compaction in a press, and then packaging the compacted casings in special containers.

It is essential that a given proportion of the mixture of hulls and end piece is respected in each casing, in order to be sure that the casings can he filled up and compacted under satisfactory and reproducible conditions. Thus for example, in the example of a cylindrical casing of about 90 l, one to three end pieces should be placed among the hulls in each casing.

In order to fill casings with hulls and end pieces transported in bulk in the same drum, respecting a given proportion of the mixture of hulls and end pieces, it is necessary to separate the hulls from the end pieces and then to proportion them when filling the casings. However, at the present time there is no device for carrying out these two operations satisfactorily.

DESCRIPTION OF THE INVENTION

The main purpose of the invention is a device designed to separate and proportion objects of different sizes such as hulls and end pieces originating from cutting irradiated nuclear fuel assemblies for packaging in casings designed to be compacted.

The invention is designed to solve this problem when objects to be separated can be mixed with a liquid such as water, particularly for safety reasons when some of these objects are pyrophoric. For example, this situation may arise when these objects originate from cutting nuclear fuel assemblies, since in this case they contain "Zircaloy" (registered trademark) fines with this characteristic.

The invention proposes a device for the separation and proportioning of different sizes of objects mixed in a liquid, comprising:

- an inner drum supported to rotate around an approximately horizontal axis, this drum having an inlet and an outlet end, and including at least one coil (32) wound in a spiral, delimiting passages through which the first relatively small objects can pass but which retains the second relatively large objects, the coil being capable of transporting these second objects towards the outlet end when the inner drum rotates;
- an outer drum surrounding the inner drum so that it collects the first objects, this outer drum being supported so as to rotate about said axis, and having one closed inlet and one outlet end, and comprising a sealed wall, and a segmented spiral ramp provided on the inside surface of the wall to transport the first objects towards the outlet end of the outer drum when this drum rotates;
- means of driving the inner and outer drums in rotation separately;
- means of introducing objects to be separated into the inlet end of the inner drum; and
- means of collecting the first and second objects at the outlet ends of the inner and outer drums respectively, comprising an outlet chute (54) placed under the outlet ends of the inner and outer drums respectively, this outlet chute including a hole under which an empty casing may be placed.

In a preferred embodiment of the invention, in particular the ends of the coil may be fixed on two rings, each of which is supported on a frame by at least two rollers allowing rotation of the inner drum.

In this case, means of driving the inner drum in rotation include toothing formed on one of the rings, and a first control means installed on the frame and engaging on said toothing.

Preferably, the outer drum also comprises two other rings rigidly attached to its sealed wall, each of these other rings being supported on a frame in the device through at least two other rollers allowing rotation of the outer drum.

In this case, the means of driving the outer drum in rotation consist of second toothing formed on one of the other rings, and a second control means installed on the frame and engaging on the second toothing.

It is beneficial if the drum outer wall comprises a cylindrical part, and a tapered part extending the cylindrical part, and the diameter of which reduces until the outlet end of this drum.

The inlet end of the outer drum is then closed by a partition in which overflow orifices are formed to limit the liquid level in the outer drum to a predetermined level. A recovery pan connected to a liquid recovery circuit is placed at least under the inlet end of the outer drum.

If the objects to be separated are hulls and end pieces originating from cutting irradiated nuclear fuel assemblies, the recovery pan and the outlet chute form part of a housing that surrounds the inner and outer drums, forming a first confinement barrier. A means of closure is provided to complement this barrier, so that the hole in the outlet chute can be closed when there is no casing in contact with this hole.

A cask capable of holding several casings is placed underneath the outlet chute in order to move casings between a filling station placed under the hole in the outlet chute and a casing cover assembly/disassembly station. A means of lifting casings is then provided in the filling station, to bring them into contact with the outlet chute.

Preferably, the device also includes cleaning means comprising at least one header located in the inner drum and at least one header located in the recovery pan.

When objects to be separated and proportioned are radioactive waste such as hulls and end pieces, the device is placed in a confinement cell. Means of introducing objects to be separated then include a reception hopper which passes through one of the cell walls and leads into the inlet end of the inner drum.

At least one camera is pointed towards the outlet end of the inner drum, and at least one camera is pointed towards the hole in the outlet chute, so that the device can be controlled either by an operator or automatically.

BRIEF DESCRIPTION OF THE DRAWINGS

We will now describe a preferred embodiment of the invention as a non-restrictive example, referring to the appended drawings in the appendix in which.

DETAILED DESCRIPTION OF PREFERRED EMBODIMENT

In the figures, reference 10 refers to a separation and proportioning device according to the invention in a general manner. More precisely, device 10 shown in the figures is designed to carry out separation and then proportioning of hulls and end pieces originating from cutting the irradiated nuclear fuel assembly, in a nuclear fuel reprocessing plant. It is to be noted that device 10 may be used to carry out the separation and proportioning of different sizes of objects in any other technical field, without departing from the scope of the invention.

Figure 1:
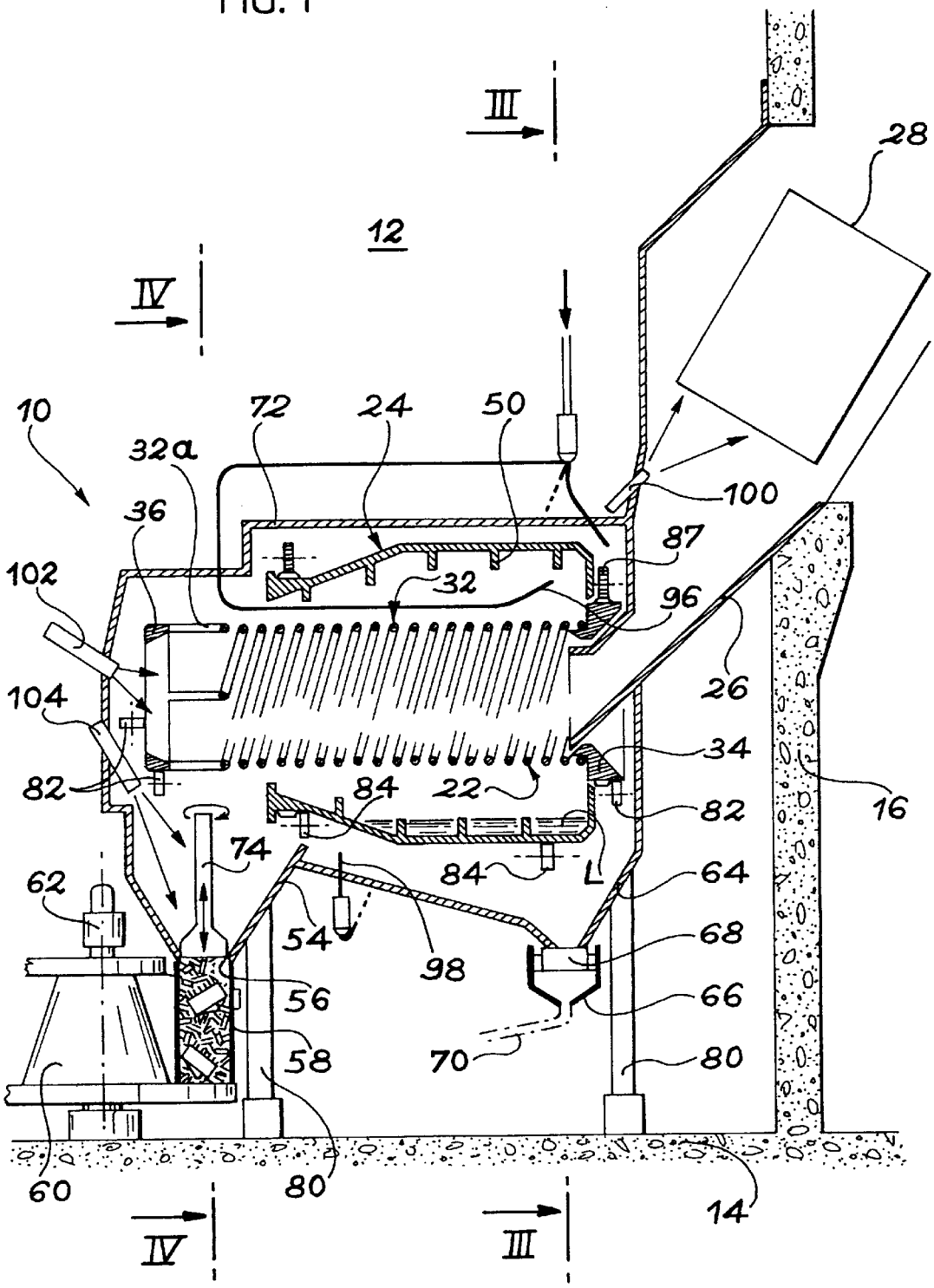
FIG. 1 is a longitudinal sectional view schematically showing a hull and end piece separation and proportioning device made in accordance with the invention.
Figure 3:
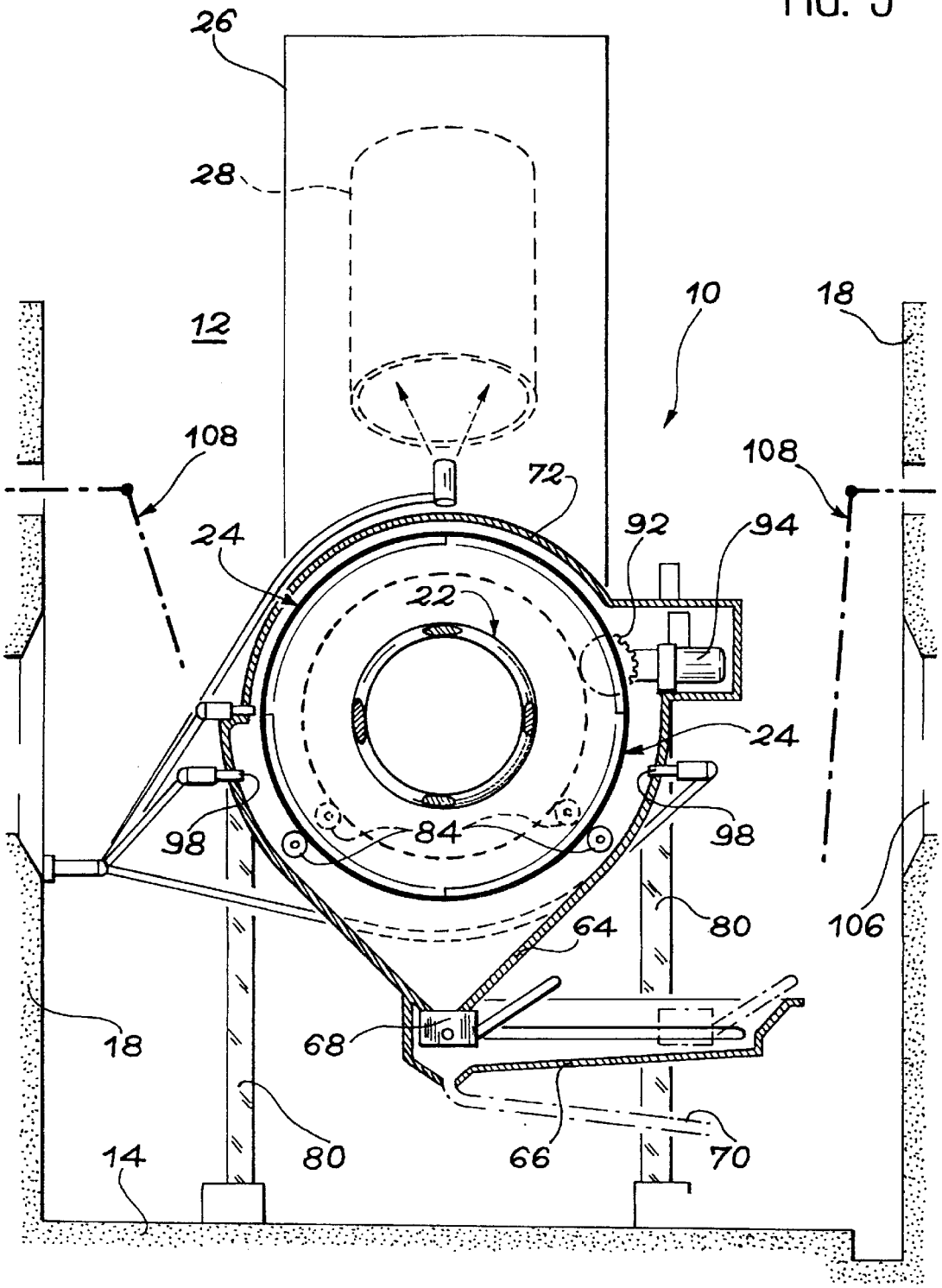
FIG. 3 is a cross-sectional view along line III—III in FIG. 1.
Figure 4:
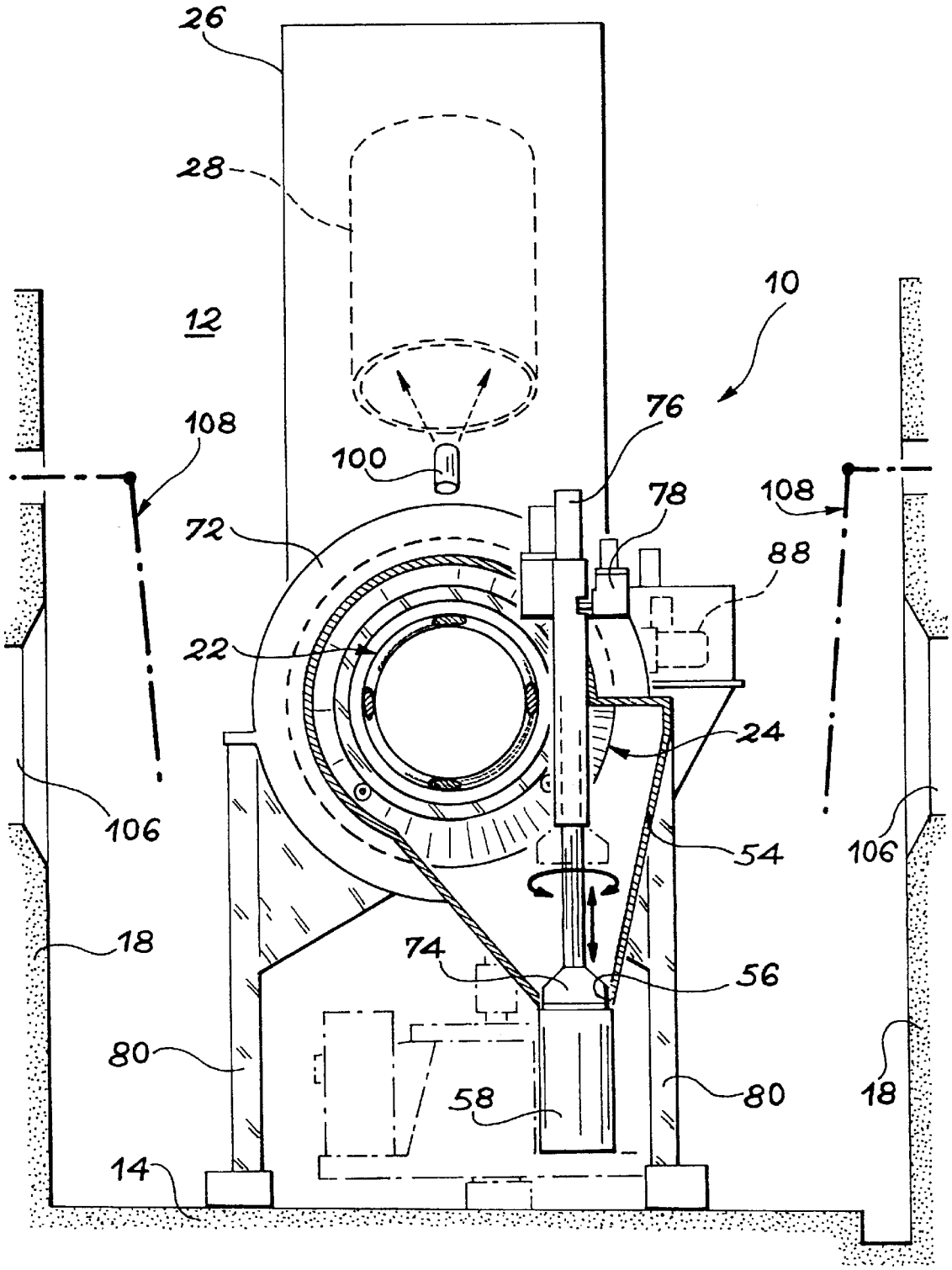
FIG. 4 is a cross-sectional view along line IV—IV in FIG. 1.

As the hulls and end pieces to be separated using device 10 are high activity waste this device is placed in a confinement cell 12, the floor of which is identified in FIGS. 1, 3 and 4 as reference 14. The front wall 16 of cell 12 also appears in FIG. 1, whereas the side walls 18 of this same cell are visible in FIGS. 3 and 4.

The separation and proportioning device 10 according to the invention comprises a frame 80 shown in a very rough manner in FIGS. 1, 3 and 4, in order to keep the drawing simple and make it easier to read. These figures only show the four stands used to support frame 80 on the cell 12 floor 14.

In the device 10 according to the invention, the separation and proportioning functions are carried out by an inner drum 22 and an outer drum 24, both of which are supported by frame 80, and being free to rotate. More precisely, the inner drum 22 and the outer drum 24 have a common horizontal axis and the outer drum 24 surrounds the inner drum 22 over most of its length.

The inner drum 22 is in the shape of a uniform diameter cylinder open at each end. The end of this inner drum 22 facing the front wall 16 of the cell forms its inlet end. Means are provided to introduce hulls and end pieces to be separated into this inlet end of the inner drum 22. In the embodiment shown in FIG. 1, these means consist of a reception hopper 26 that passes through the front wall 16 of cell 12. The lower end of this hopper 26 opens up into the inlet end of drum 22.

As shown schematically in the figures, the hulls and end pieces to be separated are routed to the reception hopper 26 in a drum 28. This drum 28 is tipped into the hopper 26 so that the hulls and end pieces contained in it drop by gravity and enter the inner drum 22 of device 10.

Figure 2:
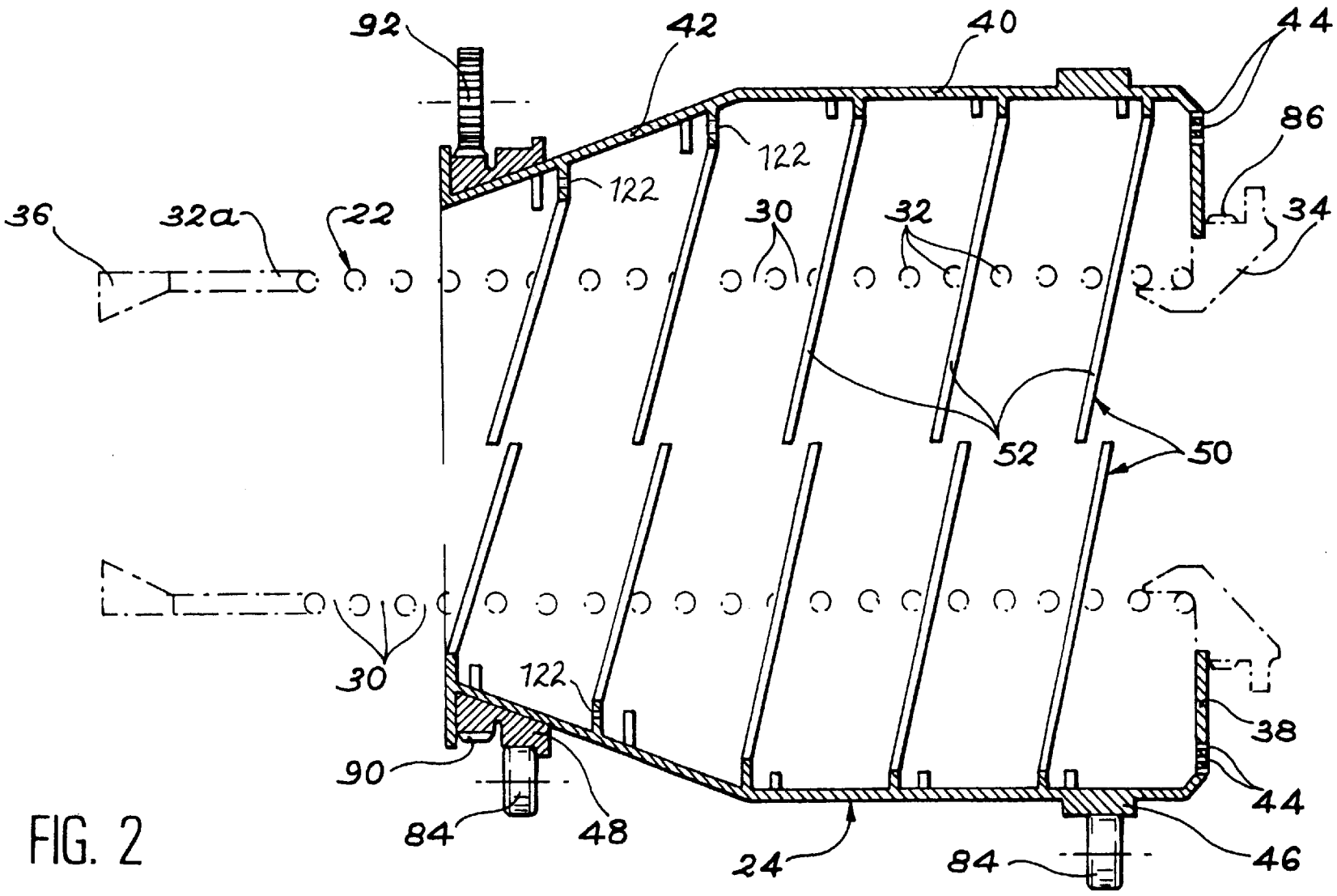
FIG. 2 is a longitudinal sectional view showing the inner and outer drums of the device in FIG. 1, on a larger scale, the inner drum being shown in chain dotted lines and the outer drum in a solid line.

The inner drum 22 which will now be described in more detail referring mainly to FIGS. 1 and 2, is designed to delimit passages 30 over most of its length and around its entire circumference, these passages retaining the end pieces while allowing hulls and all other small waste such as fines and liquids contained in cask 28, to pass. The inner drum 22 is also equipped with means of transporting end pieces from its inlet end towards the opposite end forming the outlet end of this drum when it is driven in rotation in a predetermined direction.

Consequently, the inner drum 22 comprises mainly a coil 32 wound in a spiral. This coil consists of four spiral tubes nested in each other, and with non adjacent turns. The spaces formed between the turns of the four tubes 32 form passages 30 through which the hulls, fines and liquids pass and drop into the outer drum 24 by gravity. The coil formed by the four spiral tubes 32 also forms means of routing end pieces towards the outlet end of the inner drum 22 when it is driven in rotation.

At its inlet end, the inner drum 22 has an inlet ring 34 on which the corresponding ends of the spiral tubes are welded directly. As illustrated particularly in FIG. 1, the lower end of the reception hopper 26 penetrates inside this inner ring 34.

At their opposite end, the four tubes 32 comprise straight parts 32*a* parallel to the common center line of drums 22 and 24. These straight parts 32*a* form the outlet end of the inner drum 22. The spacing between the four parts 32*a* is sufficient to enable the end pieces transported as far as this end to drop by gravity.

The end pieces of the straight parts 32*a* of the spiral tubes 32 are welded to an outlet ring 36.

The inlet rings 34 and the outlet rings 36 of the inner drum 22 form rolling tracks along which this drum is supported so that it is capable of rotating on rollers 82 supported by the device 10 frame 80. More precisely, each ring 34 and 36 is supported on at least two rollers 82, the axes of which are parallel to the horizontal axis of the drums such that drum 22 can rotate freely around this horizontal axis while remaining fixed in translation with respect to frame 80.

As shown particularly in FIGS. 1, 2 and 4, special means are provided to drive the inner drum 22 in rotation. These means include toothing 86 (FIG. 2) formed on the outside surface of the inlet ring 34. A gear 87 (FIG. 1) engaged on this toothing is driven in rotation by a motor reduction gear 88 (FIG. 4) supported by frame 80, and free to be removed. The motor reduction gear 88 is driven by gear 87 through bevel gears (not shown).

The outer drum 24 surrounds the inner drum 22 from its inlet end until close to the straight parts 32*a* of tubes 32, as shown particularly in FIGS. 1 and 2. Unlike inner drum 22, the outer drum 24 comprises a sealed wall designed to contain all waste that passes through the passages 30 in the inner drum 22, i.e. mainly the hulls, but also fines and liquids.

The outer drum 24 comprises a shaped inlet end materialized by a partition 38 perpendicular to the axis common to the inner and outer drums. This partition 38 surrounds the inner drum 22 inlet ring 34, so that it delimits a small clearance between these two parts.

Starting from this closed inlet end, the sealed wall of the outer drum 24 comprises a constant diameter cylindrical part 40 and then a tapered part 42, the diameter of which reduces until the open outlet end of this outer drum 24. This arrangement ensures that a certain amount of liquid L remains present permanently in the bottom of the outer drum 24 (FIG. 1). This avoids risks caused by the pyrophoricity of "Zircaloy" (registered trademark) fines.

This arrangement also separates most of the liquid effluents introduced in the device through the solid waste reception hopper 26, on which the separation and proportioning are to be done. Orifices 44 forming overflows are formed in the front partition 38 around the entire periphery of this partition, for this purpose. These orifices 44 are located at a distance from the common axis of the inner and outer drums exceeding the diameter of the outer drum 24 at its outlet end.

The outer drum 24 also has outer rings 46 and 48 at its inlet and outlet ends respectively, rigidly attached to its wall. Like rings 34 and 36 for the inner drum 22, these rings 46 and 48 support and drive the outer drum 24 in rotation.

Thus, each ring 46 and 48 in the outer drum 24 forms a rolling track that is supported on at least two rollers 84 supported by frame 80, so that it can rotate freely about the horizontal axis common to the inner and outer drums, while remaining fixed in translation.

Means of driving the outer drum 24 in rotation comprise toothing 90 (FIG. 2) formed on ring 48. They also comprise a gear 92 engaged on toothing 90 and driven by motor reduction gear 94 (FIG. 3) mounted on frame 80. Gear 92 is driven through bevel gears (not shown).

It is to be noted that the rotation speeds of the two drums are independent and are controlled by sensors. These rotation speeds are defined particularly in order to facilitate integration of the device in the entire reprocessing cycle.

Like the inner drum 22, the outer drum 24 is equipped with means of transporting objects such as hulls and fines that it collects at its outer end, during its rotation in a predetermined direction.

As shown in particular in FIG. 2, these means consist of a segmented spiral ramp 50 formed on the inner surface of the wall of the outer drum 24. This spiral ramp 50 extends along the entire length of the outer drum 24, from its inlet partition 38 to its open outlet end. In all, it forms five turns, three of which are in the cylindrical part 40, and the other two are in the tapered part 42.

More precisely, the spiral ramp 50 is formed by a succession of spiral segments 52 welded to the inside of the cylindrical parts 40 and the tapered part 42 of the drum wall 24. Each of these segments 52 extends around a little more than a quarter of the circumference of the drum and is slightly offset parallel to the axis of the drum, with respect to the adjacent segments. For example, this axial offset may be about 55 mm. It is to be noted that offsets between one segment 52 and the next segment are made successively in different directions, as clearly shown in FIG. 2.

Furthermore, in the cylindrical part 40 of the outer drum 24, the ends of the successive segments 52 forming the spiral ramp 50 are slightly overlapped. For illustration, each segment starts at about 45 mm before the previous segment is terminated. On the contrary, segments 52 located in the tapered part 42 of the outer drum are laid out such that one segment starts at exactly the same position as the previous segment ends. This arrangement prevents liquid from flowing backwards towards the outlet end of hulls and enables the hulls to drip.

Finally, it is to be noted that segments 52 located in the tapered part have perforations 122 near their bottom. This characteristic enables the liquid present in the outer drum 24 to flow in the tapered part 42 in the direction opposite to the direction of motion of the hulls controlled by the spiral ramp 50 during rotation of the outer drum. Thus hulls come out of the water and are dripped in tapered part 42 before being removed.

In summary, rotation of the inner drum 22 transports end pieces until the outlet end of this drum, where they drop by gravity between the straight parts 32*a* of tubes 32. Similarly, rotation of the outer drum 24 routes waste such as hulls and fines that pass through the inner drum 32, as far as its open outlet end. On the other hand, liquids received in the outer drum 24 remain in the cylindrical part 40, from which they drop by gravity through orifices 44 forming an overflow. A constant liquid level is thus maintained in the bottom of the outer drum.

The separation thus obtained between end pieces and hulls enables precise proportioning of the number of end pieces mixed with hulls at the outlet from the device, due to the separate rotation drive of the inner drum 22 and the outer drum 24.

Objects such as end pieces and hulls that drop by gravity at the ends of drums 22 and 24 respectively when the drums are driven in rotation, are collected by appropriate means placed below these outlet ends. In the embodiment shown, these means consist of a funnel-shaped outlet chute 54 placed so as to collect end pieces that drop between the straight parts 32*a* of tubes 32 of the inner drum, and the hulls that drop by gravity at the outlet end of the outer drum 24, when each of the drums rotates.

At its lower end, the outlet chute 54 comprises a circular hole 56 (FIGS. 1 and 4) under which a cylindrical casing 58 can be placed to hold hulls and casings in accordance with a predetermined proportioning.

As illustrated schematically in FIGS. 1 and 4, the device according to the invention may advantageously be fitted with a rotary cask 60 mounted directly on the floor 14 of cell 12. This rotary cask 60 can then bring an empty casing 58 as far as the filling station placed underneath the hole 56 in outlet chute 54, and then remove this casing when it is full of hulls and end pieces in the required proportion. Casings 58 are placed vertically on a tray on cask 60. When they are placed on this tray, they normally have a cover which is then taken off at a cover assembly/disassembly station (not shown), through which the empty casings pass before being routed to the filling station.

Cask 60 is also equipped with a lifting means such as a jack 62 (FIG. 1) which brings the upper edge of the casing 58 into contact on the hole 56 in the outlet chute 54 when there is an empty casing at the filling station.

When the casing is full, the jack 62 is actuated once again to lower the tray supporting the casing, so that the casing can be transported as far as the cover assembly/disassembly station. The cover is then put back onto the casing and the casing can then be transported by any means whatsoever (not shown) to a compacting press.

It is to be noted that the cask 60 may be replaced by any equivalent transfer system such as a linear conveyor.

In order to collect liquid falling by gravity through orifices 44 forming an overflow in the outer drum 24, the device according to the invention also includes a recovery pan 64 placed below the closed end of the outer drum and extending as far as the outlet chute 54. This recovery pan 64 pours the liquid into a recovery tank 66 through an interchangeable strainer 68. The bottom of the tank 66 leads into a liquid effluents recovery circuit 70.

The outlet chute 54, and the recovery pan 64, are included in a casing 72 in which the two drums 22 and 24 are enclosed. This casing is supported on floor 14 through frame 80. It forms the first confinement barrier through which the reception hopper 26 passes. The upper part of the casing 72 is preferably removable, in order to enable maintenance.

The device according to the invention also comprises a means of closing the hole 56 when a casing 58 is not in contact with hole 56 in outlet chute 54, in order to guarantee continuity of the confinement at this time.

In the embodiment shown, the closing means comprises mainly a shutter 74 placed inside the chute 54, so that it can move along its vertical axis between a high retracted position and a low closed position of hole 56, and so that it can rotate around the same axis as shown schematically by the arrows in FIG. 1. The combined translation and rotation movement of shutter 64 associates the closing function of hole 56 with a compaction function of the hulls and end pieces previously introduced into casing 58.

As shown particularly in FIG. 4, since the shutter 74 must be sufficiently retracted so that it does not hinder end pieces and hulls dropping into the outlet chute 54, the vertical axis of this shutter is offset laterally from the horizontal axis common to drums 22 and 24. Thus the drum and its control mechanism are located on the side of the inner drum 22. Consequently, the hole 56 formed in the bottom of chute 54 is also offset so that it is on the center line of shutter 74.

As shown schematically in FIG. 4, translation and rotation of the shutter 74 are controlled by a motor reduction gear 76 and a motor reduction gear 78 respectively, both of which are placed outside housing 72. Each of these motor reduction gears is preferably fitted with a torque limiter. Furthermore, a coder is used with the translation control motor reduction gear 76 for shutter 74.

The outer drum 24 is self-cleaned by hulls and other small objects scraping on its inside surface. However, cleaning headers are provided as shown particularly in FIGS. 1 and 3. These headers advantageously include a header 96 located in the outer drum 24, two headers 98 located in the recovery pan 64, a fixed jet 100 located in the reception hopper 26 and facing cask 28, and a mobile washing jet (not shown).

The device is cleaned using the above mentioned jets and headers, every time that the contents of a cask 28 has been entirely transferred into casings 58.

In the embodiment shown in the figures, the device is controlled by an operator. To assist him, he can use images output by a first camera 102 (FIG. 1) installed on the housing 72 and pointing towards the outlet end of the inner drum 22. He can also use the image supplied by a second camera 104 also fixed on housing 72 and facing inwards and towards the bottom of the outlet chute 54. The operator can also observe the outside of the device, and particularly cask 60 through at least one window 106 formed in one of the outside walls 18 of containment 12.

It is to be noted that as a variant, the device may also be controlled automatically by combining cameras 102 and 104 with a shape recognition system. In this way, it is possible to recognize the presence of an end piece at the outlet from the inner drum 22, and hulls position in casing 58, at all times.

Finally, it is to be noted that cell 12 may advantageously be equipped with intervention means such as one or several remote manipulators (schematically shown as 108 in FIGS. 3 and 4). It is thus possible to remove and replace some interchangeable parts of the device such as motor reduction gears 76, 78, 88, 94 and strainer 68, possibly after removing the upper part of the casing 72. For this purpose, this part of casing 72 and the motor reduction gears and the strainer are equipped with a suitable gripping handle.

Regardless of whether the device according to the invention is controlled automatically or by an operator, it can separate end pieces from hulls and other small objects contained in casks 28, and they can be introduced at will into casings 58, respecting controlled proportions;

Thus, the operating cycle to fill a casing 58 may be as follows, to prevent end pieces from stamping impressions in the bottom of the casing:

- rotation of the outer drum 24 only in order to transfer a first volume of hulls to bottom of the casing 58 (for example about 10 l for a casing of about 90 l);
- stop the outer drum 24 and start rotating the inner drum 22 so that one to three end pieces drop into casing 58;
- stop the inner drum 22 and start outer drum 24 rotating again, in order to terminate filling casing 58.

It is to be noted that despite recovery of liquid by the recovery pan 64, a certain amount of this liquid remains trapped in the hulls and falls into casing 58. This quantity may be about 2 l for a casing of about 90 l.

As has already been mentioned, the contents of the casing 58 that has just been filled are compacted and the hole 56 in the outlet chute 54 is closed by shutter 74, before the casing is lowered.

The presence of a certain amount of liquid in the bottom of the outer drum 24 prevents risks due to the pyrophoricity of "Zircoloy" (registered trademark) fines collected in this drum.

Furthermore, this arrangement makes it possible to recover liquid effluents for subsequent processing.

Finally, the design of the device that has been described above is capable of filling casings 58 while respecting safety conditions imposed by products that are separated and proportioned by this device.

obviously, a number of modifications may be made to the device according to the invention, particularly when the natures of objects that it is designed to separate and then proportion are different. Thus casing 72 may then be eliminated, in the same way as the means of recovering liquid effluents and the tapered part of the outer drum.

We claim:

1. Device for separating and proportioning objects of different sizes mixed with a liquid, comprising:

an inner drum supported to rotate around an approximately horizontal axis, this drum having an inlet and an outlet end, and including at least one coil wound in a spiral, delimiting passages through which the first relatively small objects can pass but which retains the second relatively large objects, the coil being capable of transporting these second objects towards the outlet end when the inner drum rotates;

an outer drum surrounding the inner drum so that it collects substantially all of the first relatively smaller objects, this outer drum being supported so as to rotate about said axis, and having one closed inlet and one outlet end, and comprising a sealed wall, and a segmented spiral ramp provided on the inside surface of the wall to transport the first objects towards the outlet end of the outer drum when this drum rotates;

means of driving the inner and outer drums in rotation separately;

means of introducing objects to be separated into the inlet end of the inner drum; and means of collecting the first and second objects at the outlet ends of the inner and outer drums respectively, comprising an outlet chute placed under the outlet ends of the inner and outer drums respectively, this outlet chute including a hole under which an empty casing may be placed.

2. Device according to claim 1, in which the inner drum also comprises two rings to which the ends of the coil are fixed, each of these rings being supported on a frame of the device by at least two rollers enabling rotation of the inner drum.

3. Device according to claim 2, in which the means of driving the inner drum in rotation comprise toothing formed on one of the rings, and a first control means installed on the frame and engaged on said toothing.

4. Device according to claim 1, in which the outer drum also comprises two other rings rigidly attached to its sealed wall, each of these other rings being supported on a device frame by at least two other rollers enabling rotation of the outer drum.

5. Device according to claim 4, in which the means of driving the outer drum in rotation comprise a second toothing (90) formed on one of the other rings, and a second control means installed on the frame and engaged on the second toothing.

6. Device according to claim 1, in which the wall of the outer drum includes a cylindrical part and a tapered part extending the cylindrical part and with a diameter that reduces up to the outlet end of this drum.

7. Device according to claim 6, in which the spiral segmented ramp is formed of spiral segments, the segments located in the tapered part being perforated at their base.

8. Device according to claim 6, in which the inlet end of the outer drum is closed by a partition through which orifices pass forming overflows, limiting the liquid level in the outer drum to a predetermined value, a recovery pan connected to a liquid recovery circuit being placed at least under the inlet end of the outer drum.

9. Device according to claim 8, in which the recovery pan and the outlet chute form part of a housing that surrounds the inner and the outer drums, a shutter being provided to close the hole in the outlet chute.

10. Device according to claim 9, in which a cask is capable of containing several casings and moving these casings between a filling station placed under the hole in the outlet chute and a casing cover assembly/disassembly station, a means of lifting casings being provided at the filling station to bring them into contact with the outlet chute.

11. Device according to any one of claims 7 to 9, in which cleaning means are provided comprising at least a header placed in the inner drum and at least a header (98) placed in the recovery pan.

12. Device according to claim 1, further comprising a confinement cell to allow the device to be used with radioactive waste, in which the means of introducing objects to be separated comprise a reception hopper that passes through a cell wall and opens out into the inlet end of the inner drum.

13. Device according to claim 12, in which at least one camera faces the inner drum outlet end and at least one other camera faces the hole in the outlet chute.

* * * * *